United States Patent [19]

Markman

[11] 4,058,054

[45] Nov. 15, 1977

[54] CAN FOLDER AND FLATTENER

[76] Inventor: Stanley Markman, 7 Copley Court, Wayne, N.J. 07470

[21] Appl. No.: 729,165

[22] Filed: Oct. 4, 1976

[51] Int. Cl.[2] ..... B30B 7/00

[52] U.S. Cl. ..... 100/233; 100/DIG. 2; 100/295

[58] Field of Search ..... 100/DIG. 2, 233, 295; 241/99; 99/571, 572, 573, 581, 582

[56] References Cited

U.S. PATENT DOCUMENTS

| | | | |
|---|---|---|---|
| 2,466,907 | 4/1949 | Nadolny | 100/DIG. 2 |
| 2,800,160 | 7/1957 | Wilson | 100/233 |
| 3,667,386 | 6/1972 | Workman | 100/DIG. 2 |
| 3,732,804 | 5/1973 | Moller | 100/DIG. 2 |
| 3,766,849 | 10/1973 | Maron | 100/DIG. 2 |
| 3,776,129 | 12/1973 | Carlson | 100/DIG. 2 |
| 3,853,054 | 12/1974 | Jacobsen | 100/233 |

*Primary Examiner*—Billy J. Wilhite
*Attorney, Agent, or Firm*—Donald R. Heiner

[57] ABSTRACT

A combined can folder and flattener having a base and pivotable handle having associated therewith two blocks or plates or anvils whereby upon rotation of the handle toward the base a can is folded and upon a second rotation of the handle toward the base the can is flattened. The folding block or plate or anvil is operatively associated with the handle such that upon loosening of a wing nut the anvil can be rotated to accomodate cans of varying lengths. The base has two holes for receiving a pin which functions as a can positioner for cans of varying lengths.

4 Claims; 5 Drawing Figures

CAN FOLDER AND FLATTENER

BACKGROUND OF THE INVENTION

The present invention relates generally to the field of can crushing and more particularly to a combined can folder and flattener which is able to accomodate cans of varying lengths. The device combines essentially a base plate, a pivotable handle, two blocks or anvils associated with a handle and a movable pin which fits into holes in the base plate for accommodating cans of varying lengths during the flattening process. The folding anvil has two faces and is associated with the handle such that it can be rotated to accomodate cans of varying lengths. A can to be folded and flattened is placed on the base, below the folding anvil, with its axial length transverse to the axial length of the base plate, and the handle is rotated downwardly toward the base thereby causing the can to fold. The handle is then raised and the folded can is removed and placed under the flattening anvil with its axial length coaxial with the base plate. The handle is rotated downwardly again and the folded can is thereby flattened.

It should be obvious that during this second or flattening operation a second can can be placed under the folding anvil, thereby folding the second can and flattening the first can with one rotation of the handle. It should be further obvious that two or more of the base plates can be secured together and a master handle provided, whereby upon rotation of the master handle two or more slave handles will be simultaneously rotated, thereby folding and flattening a plurality of cans simultaneously.

PRIOR ART

The most pertinent prior art patents uncovered during the search appear to be the patents to Nadolny et al U.S. Pat. No. 2,466,907; Wilson et al U.S. Pat. No. 2,800,160; Workman U.S. Pat. No. 3,667,386; Carlson U.S. Pat. No. 3,776,129; and Jacobsen U.S. Pat. No. 3,853,054.

The patent to Nadolny et al is seen to differ substantially from the instant invention in that it has a can crushing operation only, and necessarily depends upon a complicated crushing jaw for its operation. Further, the base plate depends, for its proper operation, upon downwardly sloping side walls for accomodating the can to be crushed.

The patent to Wilson et al discloses a wall mounted can flattening device having a movable jaw and a fixed jaw which are hinged together. As in the Nadolny et al patent, this patent teaches only a can flattening operation as opposed to the two operations provided for in the instant invention. Structurally, the patent to Wilson et al differs substantially from the instant invention.

The patent to Workman does teach the basic concept of a two-stage operation whereby the can is indented transversely of its middle to tilt its ends inwardly and then to flatten the tilted ends against the middle. However, this patent necessarily depends upon three jaws (10, B and D) and a support (13) for its operaton. Further, this patent does not teach the folding anvil of the instant invention, having two faces for accomodating cans of varying lengths.

The patent to Carlson differs from the instant invention in several aspects. First, it does not teach the two operations of the instant invention. Second, its base plate depends upon having a depression 4 for proper operation and third the structure of lever 2, pressure plate 7 and cutter 8 are substantially different from the handle and anvils of the instant invention.

The patent to Jacobsen relates to a device for crushing and folding cans as in the instant invention. However, it is seen that the handle 14 has a slot-like member 13 and a ridge or wall 15 on the opposite side for crushing and creasing respectively. The base plate of the patent must have a series of protuberances or teeth and parallel spaced apart ridges 18 for creasing. This patent does not teach the folding and flattening anvils of the instant invention nor its ability to accomodate cans of varying lengths.

SUMMARY OF THE INVENTION

Briefly, the invention relates to a can folding and flattening device wherein a lightweight, portable, inexpensive means is provided for folding and flattening cans of various diameters and lengths rapidly and economically. The device comprises a base, a pivotable or swingable arm associated with the base through means of two arm supports, a pin which functions as a can positioner operatively associated with the base, a can folding anvil having two faces operatively associated with the handle, a can flattener anvil operatively associated with the handle and a wing nut and stud for pivotally securing the folding anvil to the arm.

Accordingly, it is an object of this invention to provide a can folding and flattening device.

Another object of the invention is to provide a can folding and flattening device to accomodate cans of varying lengths.

Another object of the invention is to provide a can folding and flattening device to accomodate cans of varying diameters.

Still another object of the invention is to provide a can folding and flattening device wherein while one can is being flattened another can is being folded simultaneously.

Still another object of the invention is to provide a can folding and flattening device for folding and flattening a plurality of cans simultaneously.

Still another object of the invention is to provide a can folding and flattening device which is lighweight, portable and economical to produce.

These and other objects and advantages of the invention are believed made clear by the following description thereof taken in conjunction with the accompanying drawings wherein:

IN THE DRAWINGS

FIG. 3 is an end view of the device and taken on line 3—3 of FIG. 1.

Figures 1, 2:
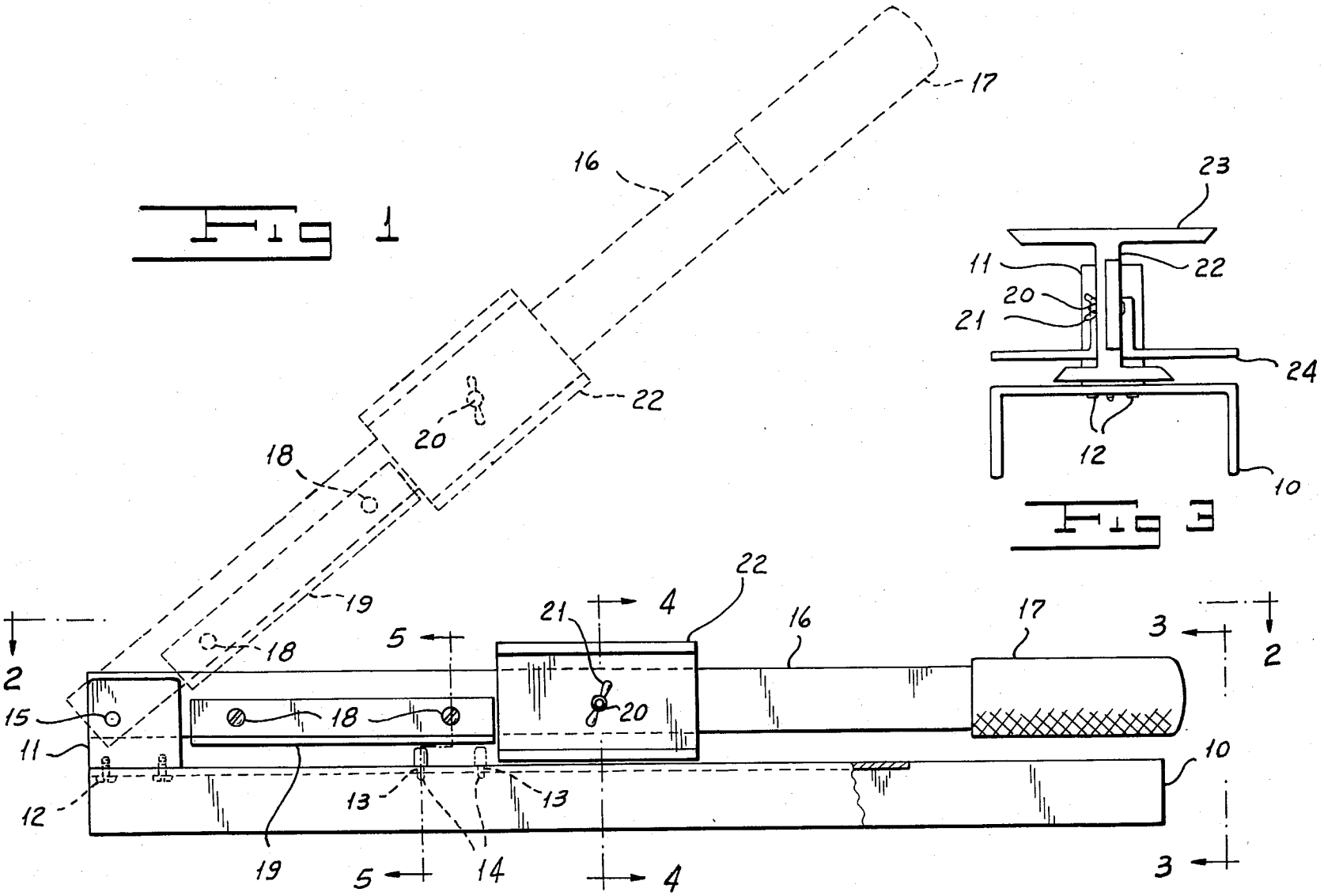
FIG. 1 is a side view of the device showing the handle in a closed position (solid) and an opened position (dotted).
FIG. 2 is a top view of the device with the handle in the closed position and taken on line 2—2 of FIG. 1.
Figure 2:
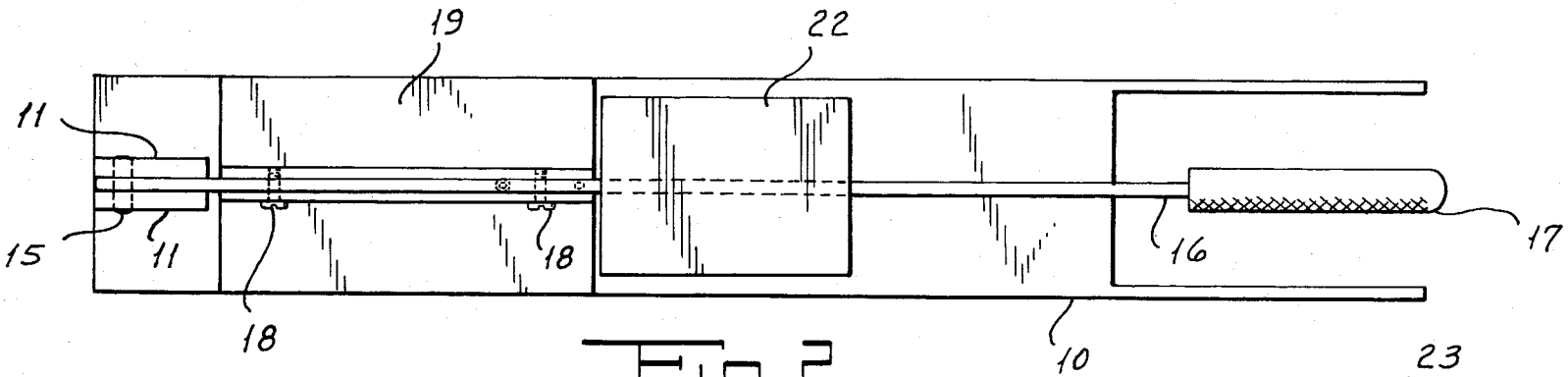
Figure 4:
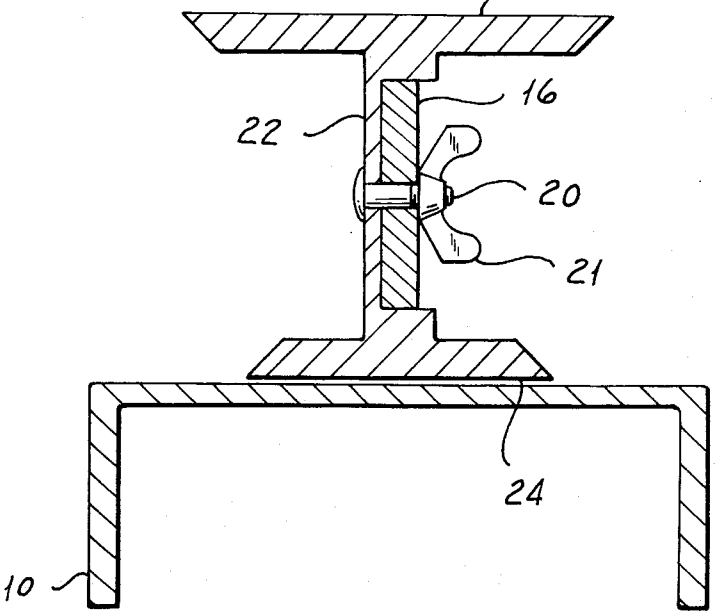
FIG. 4 is a cross sectional view taken on line 4—4 of FIG. 1.
Figure 5:
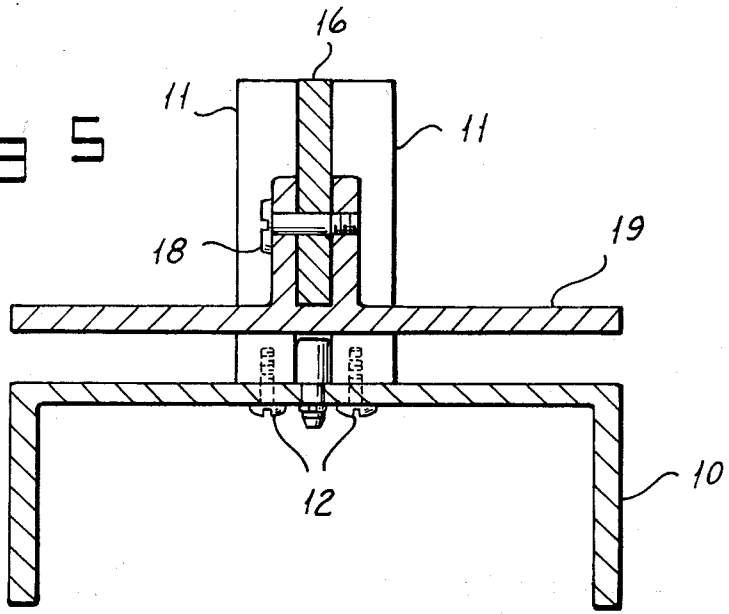
FIG. 5 is a cross sectional view taken on line 5—5 of FIG. 1.

Referring now to the drawings there is shown in FIGS. 1-2 a base plate 10 preferably of aluminum channel extrusion having two arm supports 11 fastened thereto by fastening means such as screws 12. The base plate 10 has two apertures 13 formed therein for receiving a pin 14 which functions as a can positioner to accomodate cans of varying lengths. Pivotally attached to the two arm supports 11, by means such as roll pin 15, is a swingable or pivotable handle 16 having a handle grip 17 attached to one end thereof. Secured to the handle 16 by means such as screws 18 is a can flattening anvil 19 having a width substantially the same as the base plate 10. When a can which has been folded is placed on the base plate 10, between the pin 14 and arm supports 11, the handle 16 is rotated downwardly toward the base plate 10 and the can is flattened between the base plate 10 and flattening anvil 19. Also secured to the handle 16, by means such as a stud 20 and wing nut 21, is a can folding anvil 22 having a first can folding face 23 and a second can folding face 24 wherein the second face is wider than the first face for the purpose of accomodating cans of varying lengths. When a can is to be folded it is placed on the base plate 10, under cam folding anvil 22, with its axial length transverse to the axial length of the base plate 10 and handle 16 is rotated downwardly toward the base plate 10 and the can is folded between the base plate 10 an folding anvil 22. The handle is then raised and the folded can is slid axially of anvil 22. By loosening wing nut 21 the anvil 22 can be rotated to expose either face 23 or 24 to the base plate for folding cans of different lengths. It should be obvious that two or more base plates 10 can be secured together, side by side, and a master handle ganged to the handles 16, which would then become slave handles, for the purpose of folding and flattening a plurality of cans simultaneously.

OPERATION

In operation, a can to be folded and flattened is first placed on the base plate, under the folding anvil, with its axial length transverse to the axial length of the base plate. The handle is then rotated downwardly toward the base plate, thereby causing the can to be folded between the base plate and the folding anvil. The handle is then raised and the folded can is slid axially off the anvil and placed on the base plate, between the arm supports and the pin can position, with its axial length co-axial with the base plate, and under the flattening anvil. The handle is again rotated downwardly, thereby causing the folded can to be flattened between the base plate and the flattening anvil. During this second or can flattening operation a second can can be placed under the folding anvil, thereby causing the first can to be flattened while the second can is simultaneously being folded.

It wll be understood that the invention is not to be limited to the specific construction or arrangement of the parts shown and that they may be modified widely within the invention defined by the claims.

What is claimed is:

1. A can folding and flattening device comprising:

a. A base plate having apertures formed therein for receiving a pin which functions as a can positioner;

b. Arm support means attached to said base plate;

c. A pivotable handle operatively associated with said base plate and attached to said arm support means whereby said handle can be rotated toward and away from said base plate;

d. A can folding anvil secured to said handle by means of a stud and wing nut wherein said can folding anvil comprises a first folding face and a second folding face whereby upon loosening of said wing nut said can folding anvil can be rotated to expose either of said faces to said base plate and wherein said first folding face and said second folding face are of different widths; and e. A can flattening anvil secured to said handle whereby upon rotation of said handle toward said base plate a folded can, positioned on said base plate, is caused to be flattened, said can flattening anvil having the same width as said base plate.

2. A can folding and flattening device comprising:

a. A base plate;

b. Arm support means attached to said base plate;

c. A pivotable handle operatively associated with said base plate and attached to said arm support means whereby said handle can be rotated toward and away from said base plate.

d. A can folding anvil comprising a first folding face and a second folding face wherein said folding anvil can be rotated to expose either of said faces to said base plate, said folding anvil being secured to said handle whereby upon rotation of said handle toward said base plate a can positioned on said base plate is caused to be folded; and e. A can flattening anvil secured to said handle whereby upon rotation of said handle toward said base plate a folded can, positioned on said base plate, is caused to be flattened.

3. The can folding and flattening device of claim 2 wherein said can folding anvil is secured to said handle by means of a stud and wing nut whereby upon loosening of said wing nut said can folding anvil can be rotated to expose either of said faces to said base plate.

4. The can folding and flattening devise of claim 3 wherein said first folding face and said second folding face are of different widths.

* * * * *